US006064744A

United States Patent [19]

Augustin

[11] Patent Number: 6,064,744

[45] Date of Patent: May 16, 2000

[54] OMNI-DIRECTIONAL LOUDSPEAKER

[76] Inventor: Heinz-Juergen Augustin, Billberger Strasse 6, D-39590, Storkau, Germany

[21] Appl. No.: 09/062,821

[22] Filed: Apr. 20, 1998

[51] Int. Cl.[7] ..... H04R 25/00

[52] U.S. Cl. ..... 381/160; 381/182; 381/186; 181/144

[58] Field of Search ..... 381/160, 182, 381/186, 354, 386, 387, 396, FOR 151, FOR 165; 181/144, 155, 153, 163

[56] References Cited

U.S. PATENT DOCUMENTS 5,673,329 9/1997 Wiener ..... 381/354

FOREIGN PATENT DOCUMENTS 8529497 1/1986 Germany .
4331959 6/1994 Germany .
9007103 6/1990 WIPO .

*Primary Examiner*—Huyen Le
*Attorney, Agent, or Firm*—Karl Hormann

[57] ABSTRACT

The invention relates to a loudspeaker system for omni-directional sound emission consisting of a elongate member forming an air column and a plurality of annular speaker units mounted in axially spaced relationship on the elongate member. Diffusors also mounted on the elongate member are provided with conical surfaces facing the speaker units. Electrical wiring and auxiliary speaker components such as crossover networks may be mounted in the elongate member.

14 Claims, 2 Drawing Sheets

OMNI-DIRECTIONAL LOUDSPEAKER

BACKGROUND OF THE INVENTION

1. Field of the Invention

The invention, in general, relates to a transducer for converting electrical energy into acoustical signal energy and, more particularly, to a loudspeaker-diffusor combination for emitting sound in every direction substantially normal to a given axis.

2. The Prior Art

It is known in high-quality loudspeaker systems to combine two or more speakers covering different frequency ranges so that they may correspond as closely as possible to the frequency range of human audio perception, typically from about 20 to about 20,000 hertz. The same is also true of loudspeaker-diffusor combinations designed for 360° sound emission, wherein an appropriate diffusor element is provided for the specific frequency range of substantially every speaker membrane. It is common practice in such speaker systems to position such diffusor elements opposite their associated membranes (see, for instance, DE 8,529, 497.7; 4,331,059 and WO 9,007,103).

The draw-back of such systems is that their speaker and diffusor elements are statically connected to each other by external braces. The braces are thus positioned between the active surfaces of the membranes and the diffusors on one side and a listener on the other.

In addition to the further disadvantage inherent in the complexity of the assembly of these braces and the electrical wiring of the loudspeakers supported in or by the braces, measurable acoustic distortions of the sound emission occur as a result of the shadow effect of the braces. Moreover, appearance and design of such speaker systems usually are aesthetically unpleasing.

OBJECTS OF THE INVENTION

Therefore, it is a general object of the invention to provide a loudspeaker-diffusor combination which requires no structurally unpleasant external braces.

It is also an object of the invention to provide a loudspeaker-diffusor combination which emits sound substantially without distortions in every direction.

Another object resides in the provision of a loudspeaker-diffusor combination the sound emission of which is substantially free of any shadow effect.

Still another object of the invention is to allow a statically stable assembly and electrical connection of such loudspeaker-diffusor combinations into a speaker system.

Other objects will in part be obvious and will in part appear hereinafter.

BRIEF SUMMARY OF THE INVENTION

In accordance with the invention, there is provided a novel transducer comprising a speaker-diffusor combination for emitting sound in every direction, in which all requisite speaker elements such as diaphragms, dust covers, speaker cones and speaker chassis as well as the diffusor are assembled in a statically stable manner around an air column, hereinafter sometimes referred to as a hollow axis, by means of an elongate hollow center member, the hollow member extending concentrically through an annular magnetic coil, an annular dust cover and an annular diaphragm and supporting a diffusor substantially concentrically.

Alternatively, a plurality of speaker-diffusor combinations may be arranged to surround an air column in sequential alignment with each other, the speaker-diffusor combinations being mounted on an elongate hollow member or the speaker chassis and diffusors being selectively assembled together, the diffusors being structured as statically connected hollow support members and supporting, in their otherwise empty interiors, electrical wiring for the speakers and other electrical components such as crossover networks (frequency dividers) or additional speakers provided with annular speaker elements.

Advantageously, all requisite speaker elements, diaphragms as well as diffusors are arranged around an elongate hollow center member. In one advantageous arrangement in accordance with the invention, diaphragms, dust covers and magnetic coil members are preferably of annular configuration and concentrically surround the hollow member. Electrical connecting wires such as wiring harnesses for individual speakers are disposed within the hollow elongate member. The external shape of the hollow member may be such as to function as a diffusor, and its hollow interior may be utilized for housing crossover network and other electrical components. The hollow member may be structured as a substantially straight tube or as a tube provided with a plurality of radially flaring sections of selective exterior configuration to accommodate the frequency emissions of their associated speakers and spaced sequentially to mount a plurality of speakers to form an equal number of speaker-diffusor combinations aligned relative to a common air column formed by an elongate hollow member. It is important that the connections between the speakers and diffusors is statically stable relative to the elongate hollow member.

The advantages of the invention are that signals emitted from speaker-diffusor combinations in accordance with the invention are free of acoustic distortions, and they are omni-directional without interference from braces. The quality of the emitted sound is thus significantly improved relative to known prior art systems.

Also, because external braces are no longer required, speaker-diffusor combinations in accordance with the invention can be designed which are more esthetically pleasing than hitherto known similar apparatus. Electrical wiring harnesses may be installed within the speaker-diffusor combination, hidden from the viewer's or listener's view. Several such speaker-diffusor combinations may without technical complexity be combined to form a compact speaker system.

BRIEF DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will best be understood from the following description of preferred embodiment when read with reference to the appended drawings, in which:

FIG. 1 is a schematic presentation in longitudinal section of a speaker system consisting of two speaker-diffusor combinations placed opposite each other on a common hollow post, one being a tweeter for high frequency sound emission, the other one being a woofer for midrange and low frequency sound emission, and provided with diffusors structured as a double diffusor placed between the speakers; and FIG. 2 is a schematic presentation in longitudinal section of a speaker system consisting of three speakers for high, low and intermediate frequency emissions disposed along a common hollow post having a plurality of radially flared sections functioning as diffusors.

DETAILED DESCRIPTION OF PREFERRED EMBODIMENTS

Figure 1:
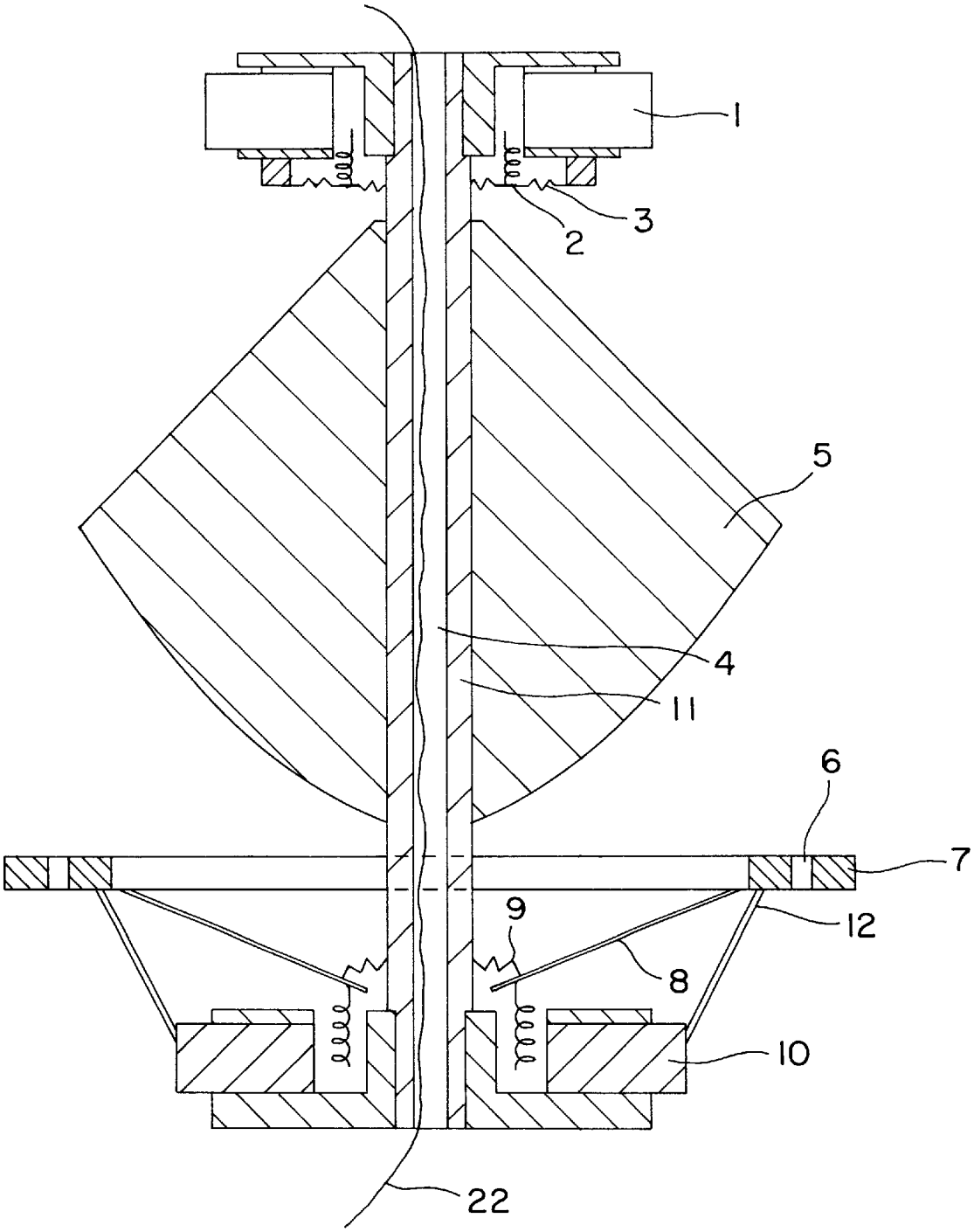

In FIG. 1, there is shown a loudspeaker system comprising, at one end thereof, a chassis 7 of a midrange and low frequency speaker surrounding an air column 4 formed by an elongate tubular member 11. The chassis 7 includes a speaker cone 12, magnet system 10, diaphragm 8, and dust cover 9 all of which are positioned concentrically around the tube 11 and, hence, the air column 4. At the other end of the tube 11, there is mounted a high frequency speaker or tweeter 1 including an annular membrane 2 and a dust cover 3.

The midrange and low frequency speakers as well as the tweeter are disposed concentrically around the tube 11. To this end the magnetic system of the tweeter 1 is provided with a central bore and is mounted at one end of the tube 11. The magnetic system 10 of the midrange and low frequency speaker (woofer) is also provided with a central bore and is mounted at the other end of the tube 11, flush with the end thereof. Between the tweeter 1 and the midrange and low frequency speaker 10, a diffusor 5 is concentrically mounted on the tube 11. The diffusor is, in fact, a double diffusor having two coaxial substantially conical sections facing in opposite directions towards the tweeter 1 and woofer 10. Advantageously, the surface structures of the conical sections are designed to accommodate the frequency spectrum or desired acoustic emission characteristics of their associated speakers. Thus, as shown by way of example, while the cone facing the tweeter 1 has a substantially planar surface the cone facing the lower frequency speaker 10 is substantially convex in its configuration.

The speaker chassis 7 is provided with a plurality of screw holes 6 to facilitate its mounting in a speaker box (not shown) which is preferably of the kind accommodating low frequencies. As shown, the air column 4 serves to provide a conduit for electrical wiring 22 connected to the tweeter 1. The tube may also serve to mount a cover (not shown) over the tweeter 1.

Figure 2:
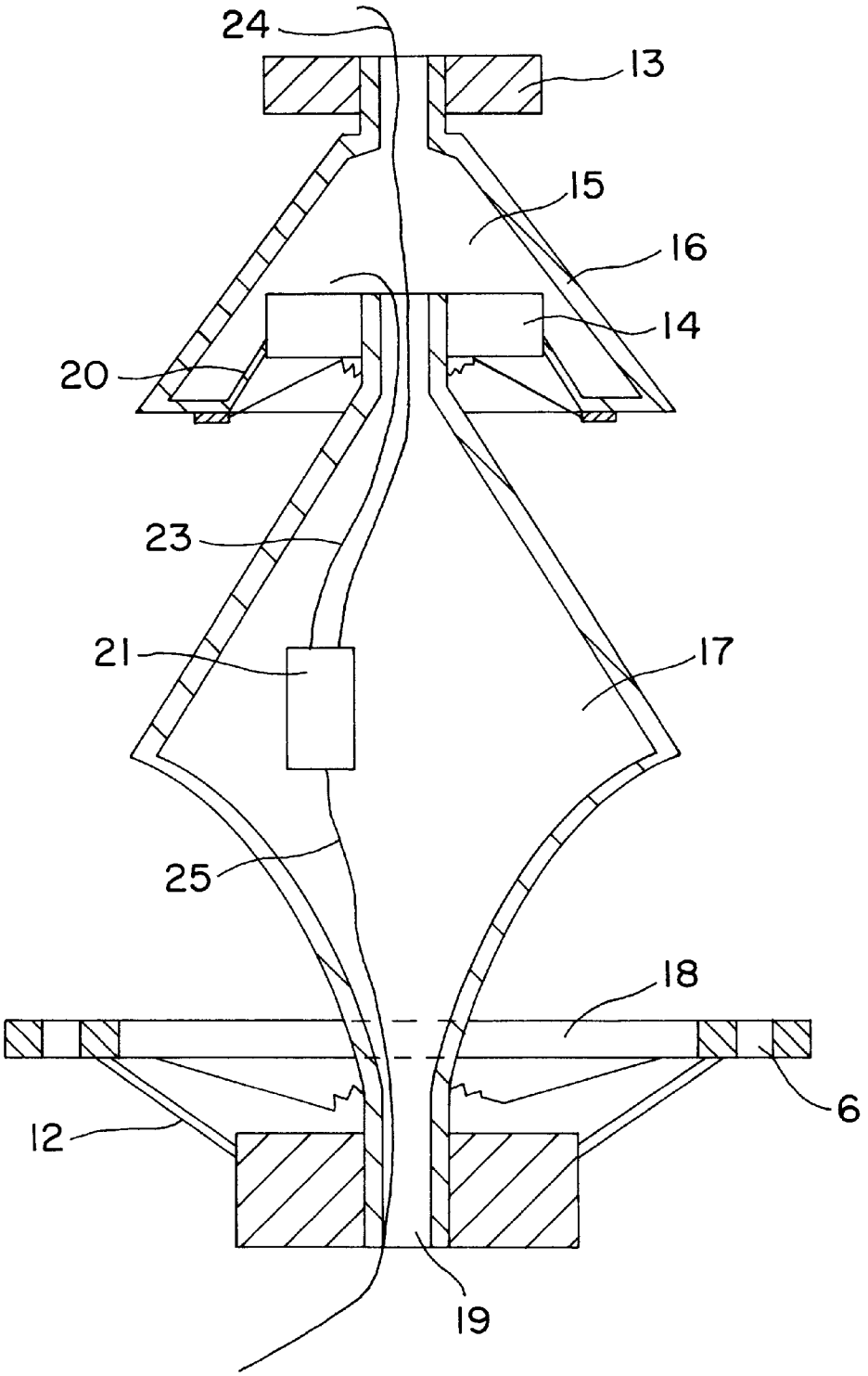

In FIG. 2, there is shown an alternative embodiment of a speaker-diffusor combination incorporating the principles of the instant invention. As shown in FIG. 2, the speaker system includes three speaker-diffusor combinations, viz.: a woofer 18, a midrange speaker 14 and a tweeter 13. The speakers are connected to each other in a statically stable manner by a double diffusor 17 placed between the midrange speaker 14 and the woofer 18, a diffusor 16 associated with the tweeter 13 and by a speaker cone 20. The three speakers are sequentially and concentrically mounted relative to an air column 19 formed by the multi-section diffusor, the tweeter 13 being positioned above the diffusor 16. A recess or cavity 15 formed by the diffusor 16 functions as a midrange frequency box for the midrange speaker 14 mounted therein.

Electrical wiring for energizing the midrange speaker 14 and the tweeter 13 is placed within the diffusors 16 and 17, and as schematically shown, a crossover network or frequency divider 21 is mounted within the diffusor 17.

What is claimed is:

1. A loudspeaker system for emitting omni-directional sound, comprising:

elongate means comprising a tubular member for forming an air column;

substantially annular first means provided on the elongate means in surrounding relationship therewith at a first position thereof for forming a loudspeaker emitting sound of a first frequency range;

substantially annular second means provided on the elongate means in surrounding relationship therewith at a second position thereof for forming a loudspeaker emitting sound of a second frequency range; and diffusor means provided on the elongate means intermediate the first and second annular means and provided with first and second substantially conical surfaces facing the first and second annular means for respectively diffusing sound of the first and second frequency ranges.

2. The loudspeaker system of claim 1, wherein the tubular member is of substantially straight configuration surrounding the air column.

3. The loudspeaker system of claim 2, wherein the first and second loudspeaker forming means are positioned at opposite ends of the tubular member.

4. The loudspeaker system of claim 3, wherein the first and second loudspeaker forming means are of annular configuration and are disposed concentrically relative to the air column.

5. The loudspeaker system of claim 4, wherein the first and second loudspeaker forming means comprise annular magnetic systems and diaphragms.

6. The loudspeaker system of claim 5, wherein at least one of the first and second loudspeaker forming means comprises a speaker cone disposed concentrically relative to the air column.

7. The loudspeaker system of claim 6, wherein the at least one loudspeaker forming means is provided with a speaker chassis disposed concentrically relative to the air column.

8. The loudspeaker system of claim 1, wherein the diffusor means comprises at least first and second axially aligned sections of the elongate means and wherein at least third substantially annular means is provided in surrounding relationship with said elongate means and for forming a loudspeaker emitting sound of a third frequency range.

9. The loudspeaker system of claim 8, wherein the first axially aligned section comprises substantially conical surface means facing the first loudspeaker forming means.

10. The loudspeaker system of claim 8, wherein the first axially aligned section comprises a recess for receiving the third loudspeaker forming means.

11. The loudspeaker system of claim 8, wherein the second axially aligned section comprises first and second substantially conical surfaces facing the third and second loudspeaker forming means.

12. The loudspeaker of claim 8, wherein the first, second and third loudspeaker forming means respectively emit high, low and midrange frequencies.

13. The loudspeaker of claim 1, wherein electrical wiring means is provided in the elongate means for energizing at least one of the first and second loudspeaker forming means.

14. The loudspeaker of claim 13, wherein crossover network means is provided in the elongate means.

* * * * *